US008403714B2

(12) United States Patent
Nakata et al.

(10) Patent No.: US 8,403,714 B2
(45) Date of Patent: Mar. 26, 2013

(54) TERMINAL FITTING

(75) Inventors: Takehiro Nakata, Yokkaichi (JP); Michiaki Okamoto, Yokkaichi (JP); Takuya Inoue, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/139,077

(22) PCT Filed: Nov. 4, 2009

(86) PCT No.: PCT/JP2009/068804

§ 371 (c)(1),
(2), (4) Date: Jun. 10, 2011

(87) PCT Pub. No.: WO2010/095318

PCT Pub. Date: Aug. 26, 2010

(65) Prior Publication Data

US 2011/0294368 A1 Dec. 1, 2011

(30) Foreign Application Priority Data

Feb. 23, 2009 (JP) ..... 2009-039642

(51) Int. Cl.
*H01R 13/02* (2006.01)

(52) U.S. Cl. ..... 439/886; 439/877

(58) Field of Classification Search ..... 439/886, 439/877

See application file for complete search history.

(56) References Cited

U.S. PATENT DOCUMENTS

| | | | | |
|---|---|---|---|---|
| 5,668,060 | A | 9/1997 | Sato et al. | |
| 5,849,424 | A * | 12/1998 | Sugawara et al. | 428/674 |
| 6,451,449 | B2 * | 9/2002 | Asakura et al. | 428/615 |
| 6,860,746 | B2 * | 3/2005 | Ota et al. | 439/181 |
| 2003/0186597 | A1 * | 10/2003 | Suzuki et al. | 439/886 |
| 2006/0057905 | A1 * | 3/2006 | McGill et al. | 439/886 |
| 2011/0009015 | A1 * | 1/2011 | Yoshida et al. | 439/886 |

FOREIGN PATENT DOCUMENTS

| | | |
|---|---|---|
| JP | 7-73769 | 3/1995 |
| JP | 10-134869 | 5/1998 |
| JP | 11-111422 | 4/1999 |
| JP | 11-121075 | 4/1999 |

* cited by examiner

*Primary Examiner* — Gary F. Paumen

(74) *Attorney, Agent, or Firm* — Gerald E. Hespos; Michael J. Porco; Matthew T. Hespos

(57) ABSTRACT

It is aimed not to increase contact resistance between a wire and a wire crimping portion even upon being subjected to a thermal cycle. A gold plating layer is formed on a base metal (20) via a nickel plating layer (21) in a terminal contact portion (11) to be held in contact with a mating terminal. A tin plating layer (23) is formed on the base metal (20) without via the nickel plating layer (21) in a wire crimping portion (12) to be crimped and connected to a core (15) of an insulated wire (14).

8 Claims, 12 Drawing Sheets

TERMINAL FITTING

BACKGROUND OF THE INVENTION

1. Field of the Invention

The present invention relates to a terminal fitting including a gold plating layer in a terminal contact portion.

2. Description of the Related Art

A terminal fitting used in a connector has a structure including a terminal contact portion to be held in contact with a mating terminal and a wire crimping portion to be crimped and connected to a core of an insulated wire, and a copper alloy or brass material is generally used as a base material. In such a terminal fitting, a thin gold plating layer is locally formed in the terminal contact portion to improve electrical contact reliability with the mating terminal.

In the case of gold-plating a terminal made of a copper alloy or brass material, it is a technical common sense to form a nickel plating layer on a base material beforehand and form a gold plating layer thereon as disclosed, for example, in Japanese Unexamined Patent Publication No. H07-73769 below to prevent diffusion of gold atoms into the base material.

On the other hand, in a terminal fitting to be crimped and connected to a wire as described above, a relatively soft tin plating layer is formed in a wire crimping portion to improve adhesion between a core of the wire and a base material of the terminal fitting, thus an electrical contact property. Then, in the case of the above terminal fitting with the gold plating layer, metal layers are laminated in the order of the base material, the nickel plating layer and the gold plating layer in the terminal contact portion and in the order of the base material, the nickel plating layer, the tin plating layer and the gold plating layer in the wire crimping portion.

A terminal fitting with a wire of this type, particularly the one for vehicle may be used in an atmosphere with a severe thermal environment such as in an engine compartment. In recent years, attention has been paid to such a phenomenon that, if a connector is used under such an atmosphere, contact resistance between a terminal fitting and a wire gradually increases and there has been a demand for a countermeasure. Conventionally, attempts have been made to solve such a phenomenon by increasing a crimping force or forming serration grooves on the wire crimping portion, assuming that this phenomenon results from a problem in contact interfaces between the wire and the terminal fitting surface.

However, a study of the present inventors could find out not only a problem in the contact interfaces between the wire and the terminal fitting, but also a large problem in the construction of the metal layers in the wire crimping portion. Specifically, in the wire crimping portion of the above terminal fitting, the metals are laminated in the order of the base material, the nickel plating layer and the tin plating layer. The tin plating layer is relatively soft and originally has good adhesion to the core. However, since the nickel plating layer is present under the tin plating layer, alloying of the tin plating layer and the nickel plating layer is promoted and a nickel atomic ratio on the surface gradually increases under a high-temperature environment. Then, properties of the tin plating layer such as softness and low specific resistance are lost, and the contact interfaces may finely move due to thermal expansion/contraction and contact resistance may gradually increase upon being subjected to a thermal cycle. This has been a mechanism of increasing the contact resistance of the conventional gold-plated terminal fitting with the wire.

SUMMARY OF THE INVENTION

The present invention was developed in view of the above situation and an object thereof is to provide a terminal fitting and a production method therefor which can suppress an increase of contact resistance between a wire and a wire crimping portion even upon being subjected to a thermal cycle.

The present invention is directed to a terminal fitting in which a gold plating layer is formed on a base metal in a terminal contact portion to be held in contact with a mating terminal and a tin plating layer is formed on the base metal in a wire crimping portion to be crimped and connected to a core of an insulated wire, characterized by being structured such that a nickel plating layer is present between the base metal and the gold plating layer in the terminal contact portion and no nickel plating layer is present between the base metal and the tin plating layer in the wire crimping portion.

According to this construction, an increase of specific resistance of the wire crimping portion and an increase of contact resistance at a contact interface with the wire can be prevented since nickel atoms do not diffuse into the tin plating layer to form an alloy layer in the wire crimping portion.

In this means, if the base metal is a copper alloy and the terminal contact portion includes a resilient contact piece to be held in contact with a mating male terminal, an excellent female terminal fitting can be obtained if the nickel plating layer is present between the base metal and the gold plating layer in the resilient contact piece and no nickel plating layer is present between the base metal and the tin plating layer in the wire crimping portion (means 2).

In the above means, if the base metal is a brass and the terminal contact portion includes a tab portion to be held in contact with a mating female terminal, an excellent male terminal fitting can be obtained if the nickel plating layer is present between the base metal and the gold plating layer in the tab portion and no nickel plating layer is present, but a copper plating layer is present between the base metal and the tin plating layer in the wire crimping portion (means 3).

If the wire crimping portion includes a pair of wire barrel pieces extending from a terminal bottom plate portion, it is preferable that the nickel plating layer is not present between the base metal and the tin plating layer in the wire crimping portion and the tin plating layer is formed to extend up to a position between extending base portions of the wire barrel pieces at a side of the terminal contact portion and the terminal contact portion (means 4). According to the construction of this means 4, diffusion of nickel atoms into the tin plating layer in the wire crimping portion can be reliably prevented.

If it is tried to improve a contact property with the core of the insulated wire by forming a recess or projection on a surface of the base metal in the wire crimping portion, the nickel plating layer may be present between the base metal and the gold plating layer in the terminal contact portion and no nickel plating layer may be present between the base metal and the tin plating layer and the tin plating layer may be in contact with the base metal at least at the peripheral edge of an edge portion formed by the recess or projection in the wire crimping portion (means 5). According to the construction of this means 5, the peripheral edge of the edge portion formed by the recess or projection is most effective since it is subjected to a strongest force when the wire crimping portion is crimped and connected to the core.

In the above respective means, the tin plating layer preferably overlaps an end edge portion of the nickel plating layer at a side of the wire crimping portion (means 6). According to this, exposure of the base metal can be reliably prevented even if there is a dimensional error in forming the plating layers. Thus, it is possible not only to suppress an increase of contact resistance in the wire crimping portion, but also to reliably prevent oxidation of the base metal.

According to the present invention, the terminal fitting can suppress an increase of contact resistance between the wire and the wire crimping portion even upon being subjected to a thermal cycle since penetration of nickel atoms into the tin plating layer can be prevented.

DETAILED DESCRIPTION OF THE PREFERRED EMBODIMENTS

A first embodiment in which the present invention is applied to a female terminal fitting is described with reference to FIGS. 1 to 7.

Figure 1:
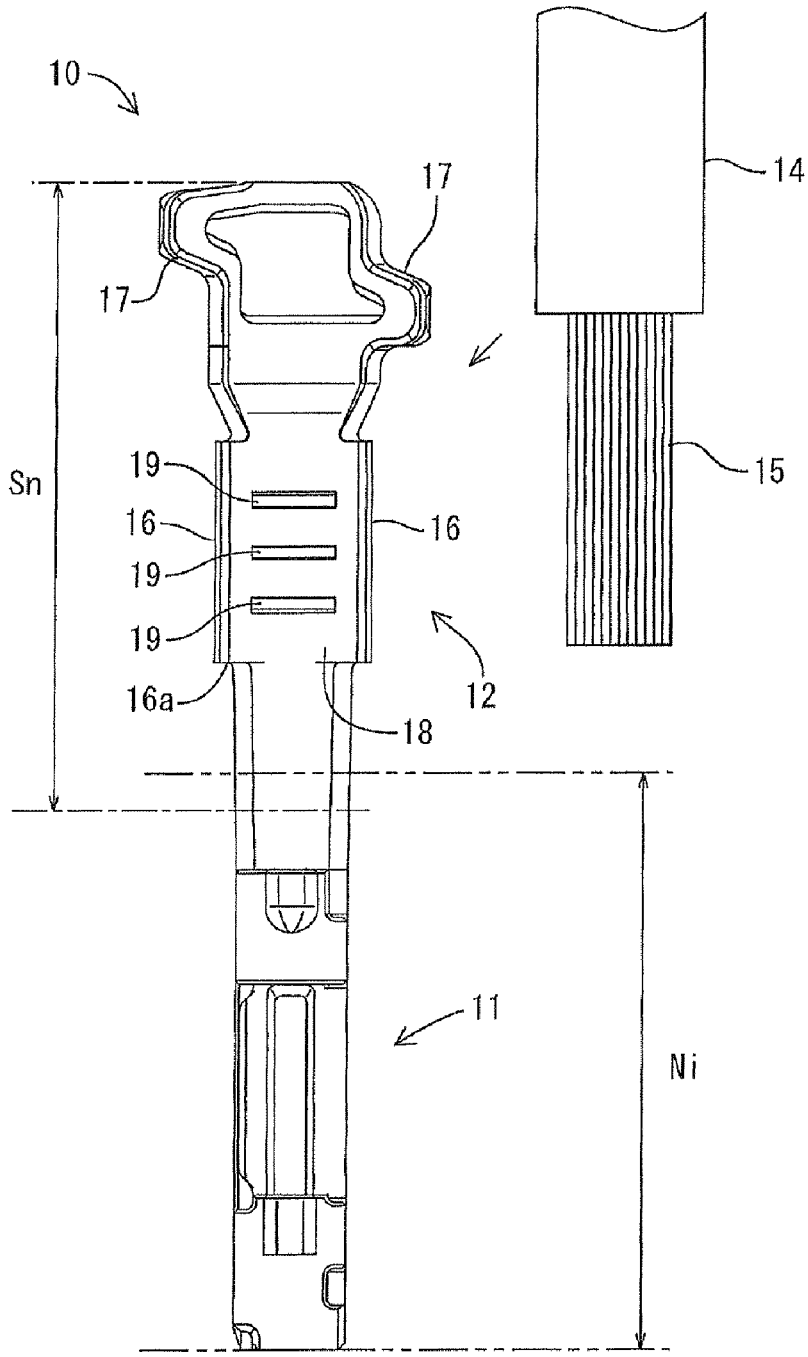
FIG. 1 is a plan view of a female terminal fitting according to a first embodiment of the invention.

The entire structure of the terminal fitting 10 is as shown in a plan view of FIG. 1. Specifically, a terminal contact portion 11 in the form of a rectangular tube is formed at a leading end side (lower side in FIG. 1) of the terminal fitting 10 and a wire crimping portion 12 is formed at an opposite side.

A resilient contact piece 13 (shown only in FIG. 2) folded in U-shape from the leading end is provided in the terminal contact portion 11, and a tab portion of an unillustrated male terminal fitting as a mating terminal is inserted to come into contact with the resilient contact piece 13.

The wire crimping portion 12 includes a pair of wire barrel pieces 16 to be crimped and connected to a core 15 of an insulated wire 14 and a pair of insulation barrel pieces 17 to be crimped and connected to an insulated part of the insulated wire 14. The wire barrel pieces 16 extend opposite to each other from lateral edges of a semicylindrical terminal bottom plate portion 18, and the insulation barrel pieces 17 similarly extend from the lateral edges of the terminal bottom plate portion 18. The respective wire barrel pieces 16 are located closer to the wire contact portion 11 than the insulation barrel pieces 17. Note that, for example, three recesses (serration grooves) 19 extending in a direction orthogonal to a longitudinal direction of the insulated wire 14 are formed in a part of the terminal bottom plate portion 18 of the wire crimping portion 12 where the wire barrel pieces 16 are formed.

A base metal of this terminal fitting 10 is a copper alloy, and plating is applied to a surface thereof. The type, procedure and method of plating are described next.

Figure 2:
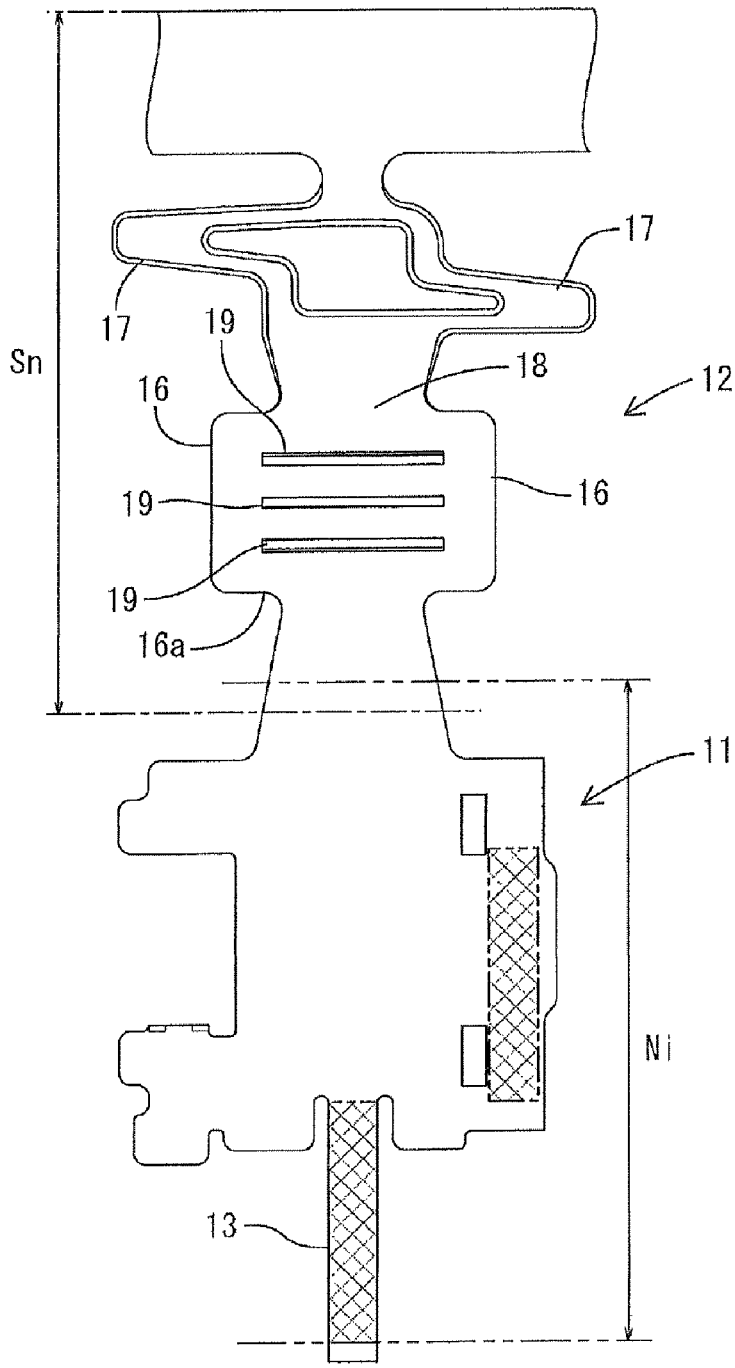
FIG. 2 is a development view of the female terminal fitting.

The terminal fitting 10 shown in FIG. 1 is formed by punching a hoop material of a copper alloy plate into a desired shape and bending the punched material by a press as known. A development shape is as shown in FIG. 2, and respective parts thereof are identified by the same reference numerals as parts constituting the terminal fitting 10 shown in FIG. 1. Plating is applied to the hoop material before press-working.

Figure 3:
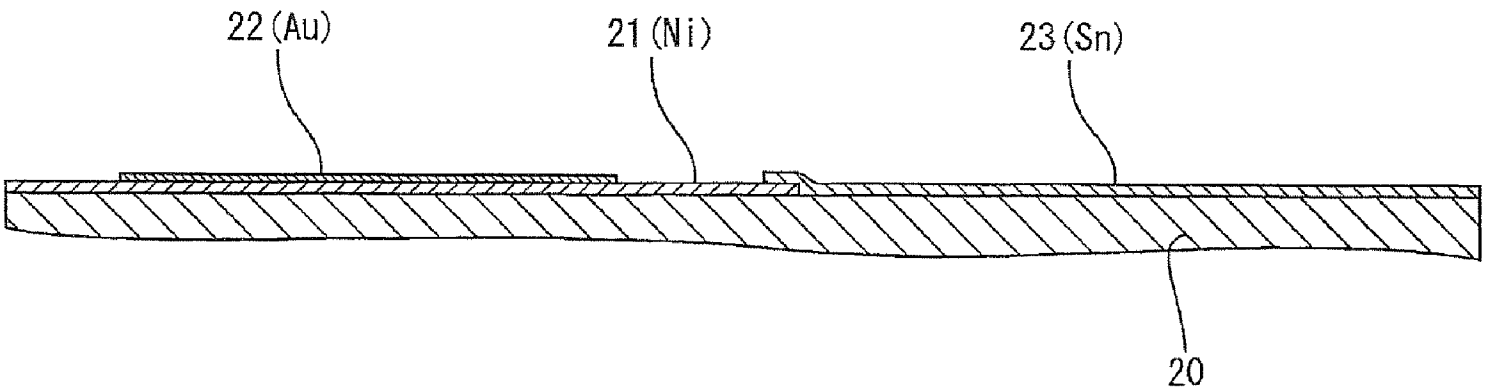
FIG. 3 is an enlarged section showing the construction of plating layers.
Figure 4:
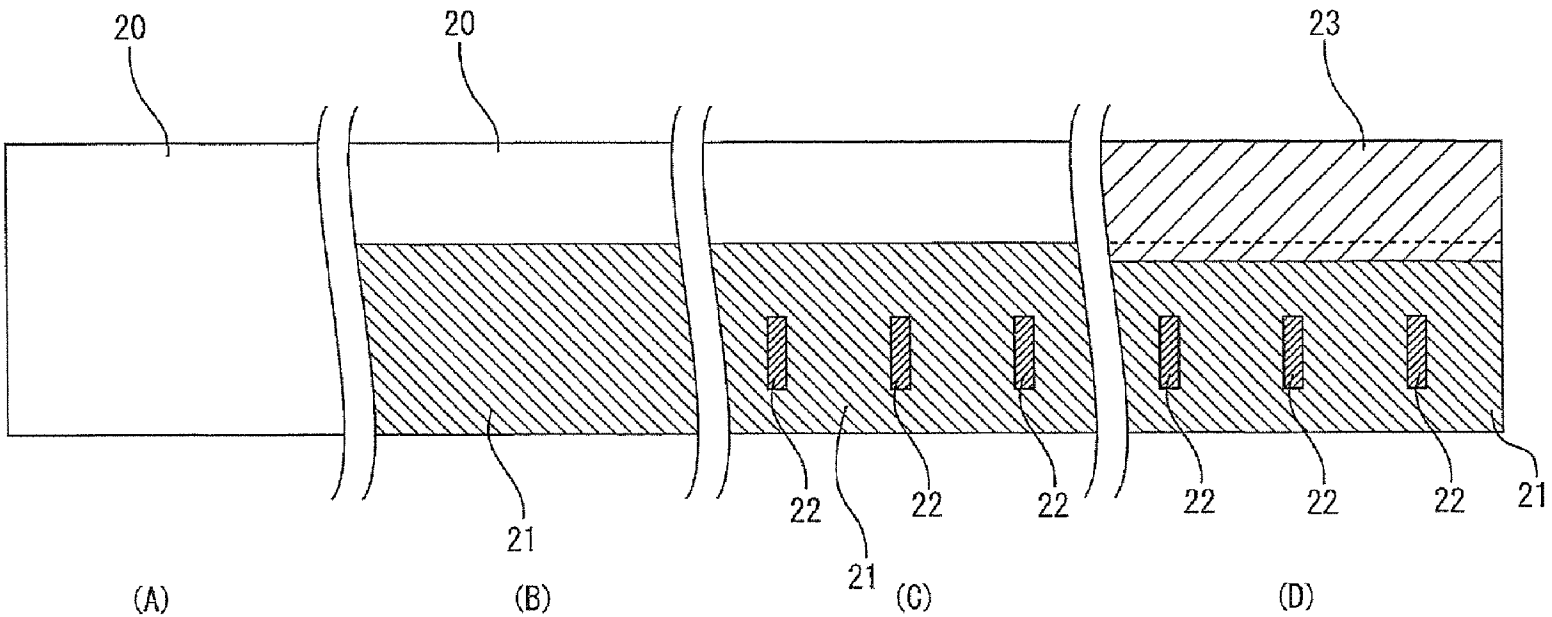
FIG. 4 is a front view diagrammatically showing a process of forming plating layers on a base metal plate.
Figure 5:
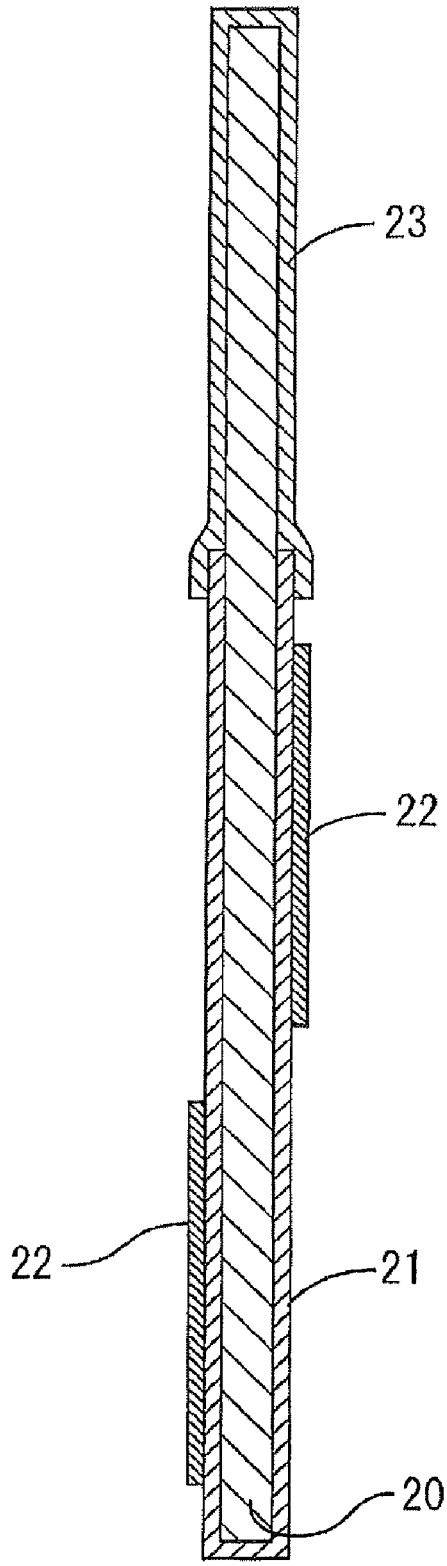
FIG. 5 is a section of the base metal plate after plating formation.

Finally formed plating layers are diagrammatically shown in FIGS. 3 and 5, and procedures of forming them are as follows.

Figure 6:
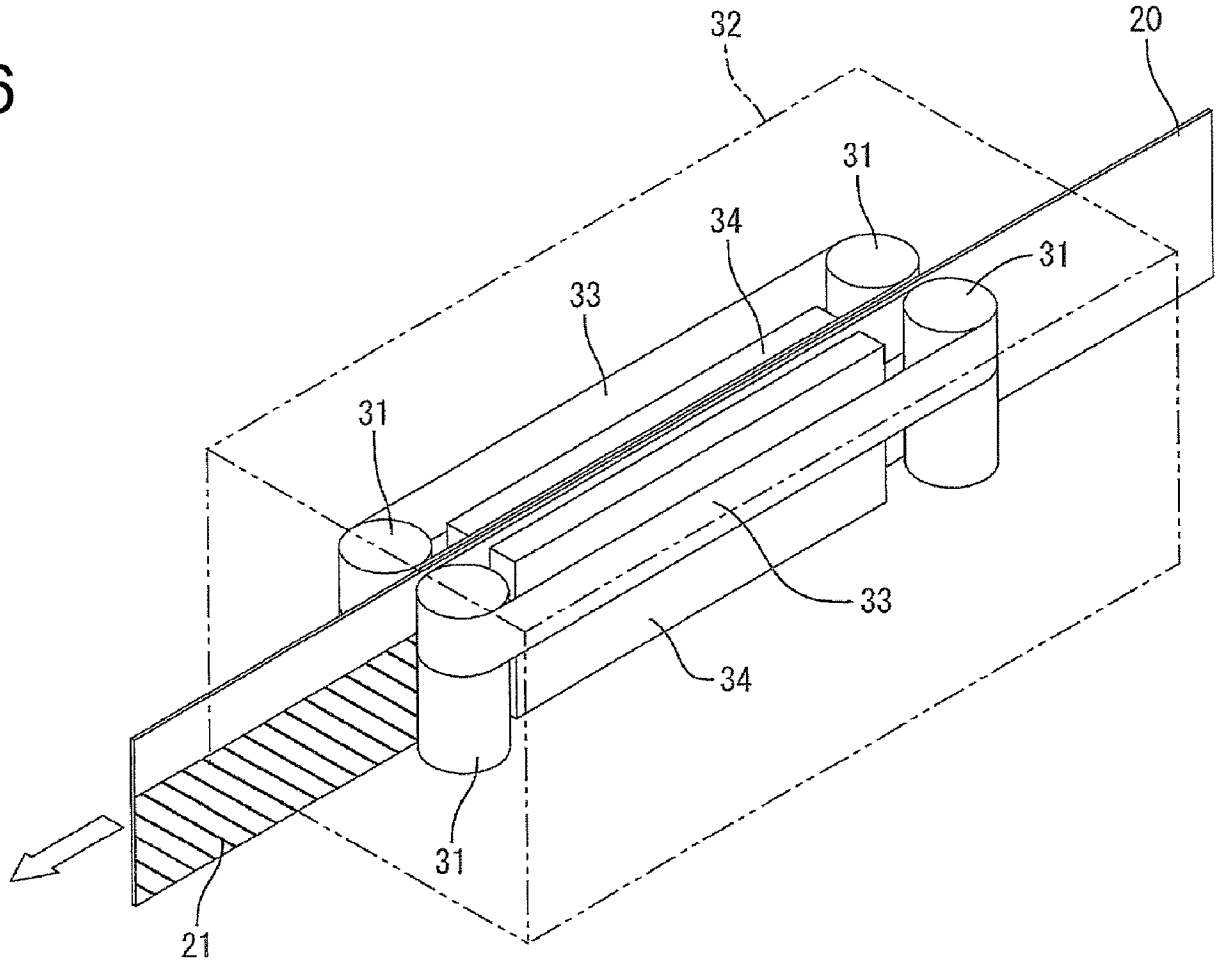
FIG. 6 is a perspective view showing an apparatus for partial plating.

First, pre-processing such as pickling is applied to the base metal plate 20 (FIG. 4(A)). Subsequently, a nickel plating layer 21 is formed on a substantially lower half of the base metal plate 20. This layer is formed to have, for example, a thickness of 1.0 μm to 1.3 μm by a normal plating process of the terminal fitting of this type. To partly plate the base metal plate 20, a plating apparatus with a masking device as shown in FIG. 6 is, for example, used. In FIG. 6, identified by 31 are four belt driving rollers provided in a plating bath 32 and by 33 are two mask belts each mounted between two belt driving rollers 31. The base metal plate 20 is continuously supplied to travel between the mask belts 33 and both sides of an upper half thereof is closely covered by the mask belts 33 when the base metal plate 20 travels in an arrow direction in the plating bath 32.

At inner sides of the respective mask belts 33, plating electrodes 34 are so provided as to be positioned at the opposite sides of the base metal plate 20. A nickel plating solution is stored in the plating bath 32, the base metal plate 20 is so supplied as to pass through the plating bath 32 in a state where at least the mask belts 33 are immersed, and a voltage is applied between the plating electrodes 34 and the base metal plate 20. In this way, a nickel plating layer 21 is formed in the lower half of the base metal plate 20 not covered by the mask belts 33. Note that an area where the nickel plating layer 21 is formed is as indicated by Ni in FIGS. 1 and 2 and this area covers the entire area of the terminal contact portion 11 and an area up to a substantially middle position between the terminal contact portion 11 and the wire crimping portion 12. In other words, the nickel plating layer 21 is not formed in the entire area of the wire crimping portion 12.

Subsequently, gold plating layers 22 are formed at necessary positions (see FIG. 4(C)). The gold plating layers 22 are formed by a so-called gold flash plating method and the thickness thereof is preferably, for example, 0.4 μm to 0.8 μm. Plated positions are on the resilient contact piece 13 and a part of the inner peripheral surface of the terminal contact portion 11 facing the resilient contact piece 13 and shown by cross-hatching in FIG. 2. Note that the gold plating layers 22 are actually formed on the underside of the resilient contact piece 13 in FIG. 2.

Finally, a tin plating layer 23 is formed (see FIG. 4(D)). The tin plating layer 23 is formed by passing the base metal plate 20 through an unillustrated plating bath in a posture vertically inverted from a posture, in which nickel plating was performed, whereby only the lower half of the base metal plate 20 is immersed in a plating solution to perform partial plating. Accordingly, the formation area of the tin plating layer 23 is determined depending on a depth of immersion of the base metal plate 20 into the plating solution. In this embodiment, the formation area of the tin plating layer 23 is indicated by Sn in FIGS. 1 and 2.

As shown in FIGS. 1 and 2, the tin plating layer 23 is formed over the entire area of the wire crimping portion 12 and extends up to an intermediate position between extending base portions 16*a* of the wire barrel pieces 16 at a side of the terminal contact portion 11 and the terminal contact portion 11. Since the nickel plating layer 21 is not formed in the wire crimping portion 12 as described above, the tin plating layer 23 is formed in contact with the surface of the base metal plate 20. At a boundary between the tin plating layer 23 and the nickel plating layer 21, the tin plating layer 23 overlaps an end edge portion of the nickel plating layer 21 at a side of the wire crimping portion 12 (see FIGS. 3 and 5).

Upon producing a wire with a terminal fitting using the terminal fitting 10 having the above construction, the leading end of the insulated wire 14 is stripped to expose the core 15, the wire barrel pieces 16 are crimped and connected to an exposed part of the core 15, and the insulation barrel pieces 17 are crimped and connected to a part of the insulation coating.

When the wire crimping portion 12 is crimped and connected to the insulated wire 14, the pair of wire barrel pieces 16 are so deformed as to be curled inwardly and strongly wrap around the core 15. At this time, since the soft tin plating layer 23 is present at the inner sides of the wire barrel pieces 16, the tin plating layer 23 is softly deformed to come into contact with the core 15 and, in some cases, is condensed with the metal constituting the core 15, whereby low contact resistance is obtained. Particularly in this embodiment, since the recesses 19 are formed in the terminal bottom plate portion 18, edge portions thereof bite into the core 15, wherefore a more reliable electrically conductive state can be obtained.

Even if this wire with the terminal fitting is used at a position repeatedly exposed to high temperatures such as in an engine compartment of a vehicle, contact resistance is stable in the long term since the nickel plating layer 21 is not present in the wire crimping portion 12. Specifically, if the nickel plating layer is present under the tin plating layer as before, nickel atoms of the nickel plating layer gradually diffuse into tin plating layer, the tin plating layer is alloyed with nickel and the resistance of the alloyed tin plating layer itself increases and the oxidation of the surface thereof advances, resulting in a phenomenon of gradually increasing contact resistance, when a thermal cycle is repeated. However, in this embodiment, this can be reliably suppressed.

The following test data factually confirm this phenomenon. The terminal fitting 10 (example) described in this embodiment and a terminal fitting (comparative example) in which a nickel plating layer was formed over the entire surface and present under a tin plating layer also in a wire crimping portion 12 were compared. In both the example and the comparative example, the terminal fittings and wires were left in a high-temperature high-humidity condition of 85° C. and 90% RH for 24 hours before connection to the wires by crimping and, thereafter, the terminal fittings were crimped and connected to the wires. At this time, resistance was measured (this is called O-cycle resistance) at an open-circuit voltage of 20 mV and a conduction current of 10 mA.

Figure 7:
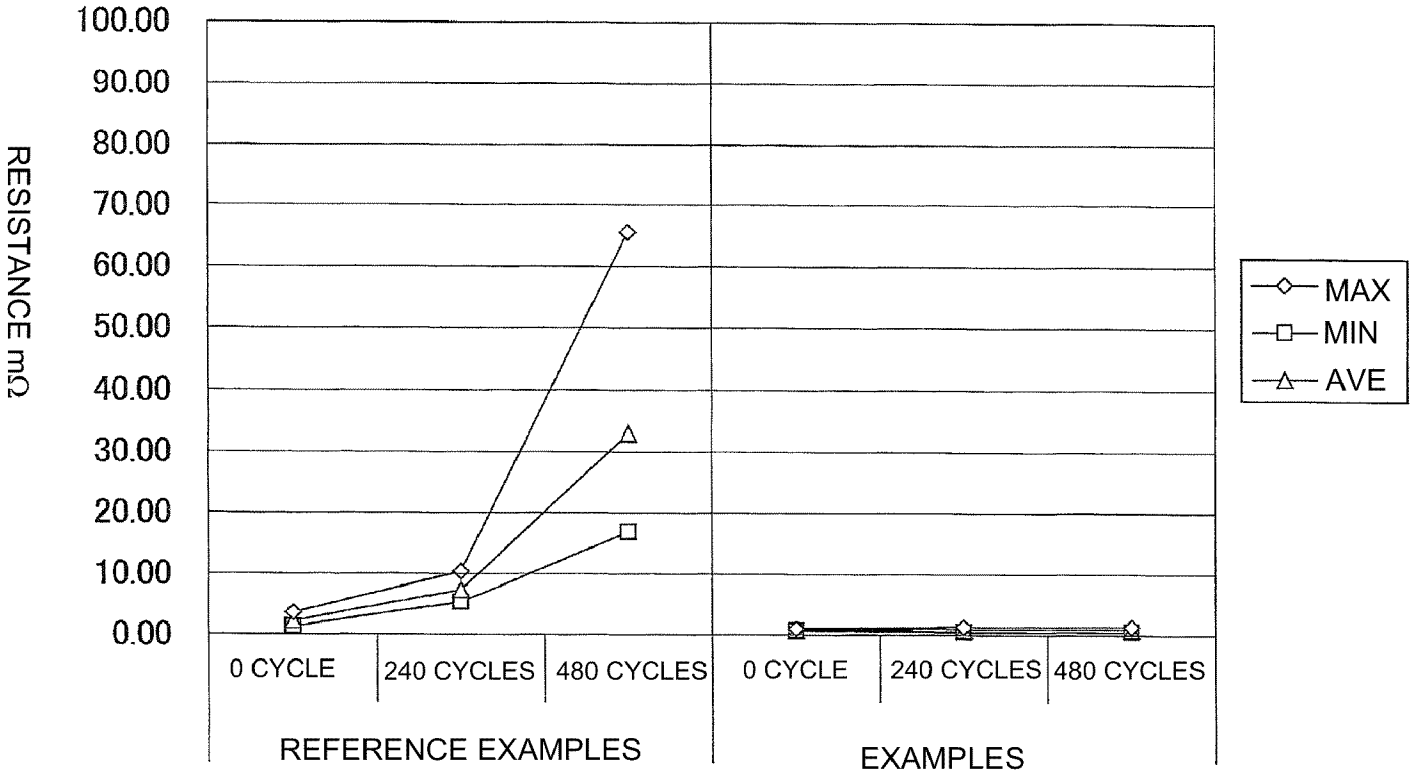
FIG. 7 is a graph showing a resistance increasing phenomenon caused by a thermal cycle.

Next, a thermal cycle of keeping at 120° C. for 10 minutes and keeping at −40° C. for 10 minutes was repeated and resistances were measured on the same conditions as above in 240 cycles and 480 cycles (these resistances are called 240-cycle resistance and 480-cycle resistance). These tests were carried out using 10 samples, maximum, minimum and average values of the respective resistance values were measured. A measurement result is as shown in FIG. 7. The 480-cycle resistance was drastically increased in the comparative example, whereas the 480-cycle resistance hardly changed in the terminal fitting 10 of this embodiment. In other words, the terminal fitting 10 of this embodiment has an excellent effect of being able to sufficiently suppress an increase of contact resistance between the wire 10 and the wire crimping portion 12 even upon being subjected to a thermal cycle.

Figure 8:
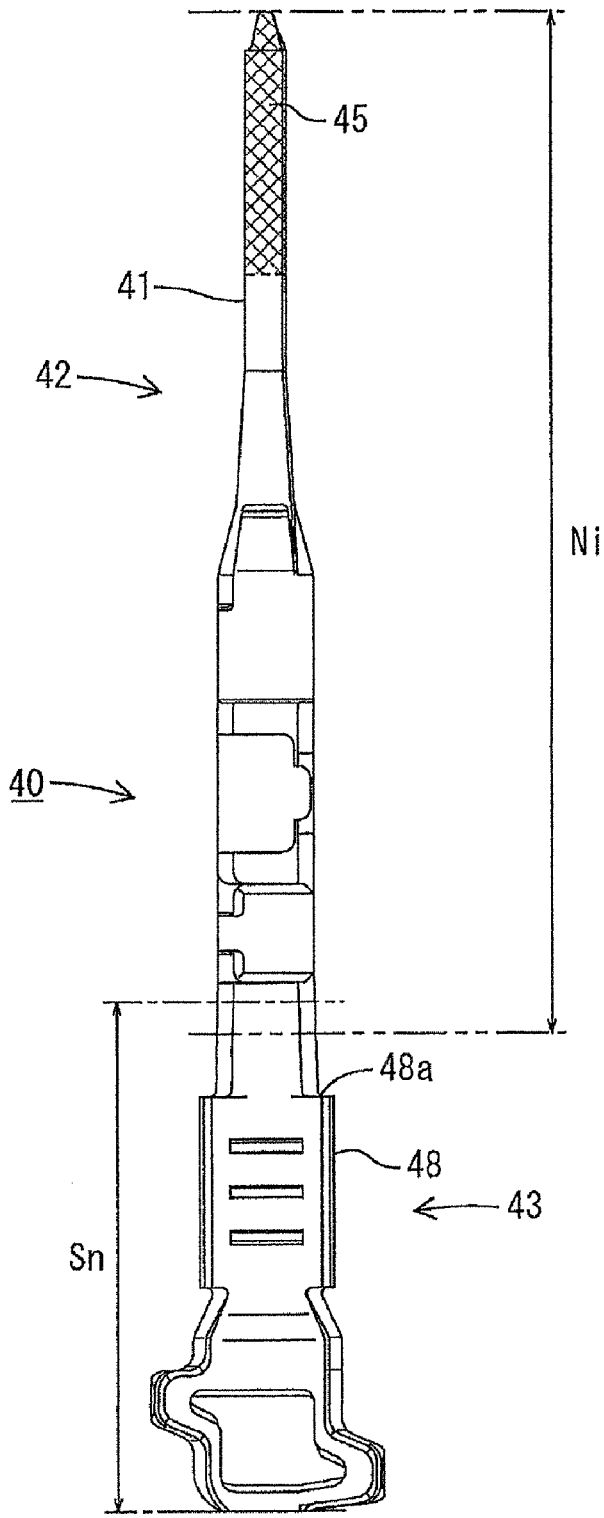
FIG. 8 is a front view of a male terminal fitting according to a second embodiment of the invention.

FIG. 8 shows a second embodiment in which the present invention is applied to a male terminal fitting 40. A terminal contact portion 42 including a tab portion 41 which comes into contact with a mating female terminal is formed at a leading end side of the terminal fitting 40 located at the right side in FIG. 8, and a wire crimping portion 43 is formed at an opposite side. The wire crimping portion 43 has the same shape as the wire crimping portion 12 of the first embodiment.

Figure 9:
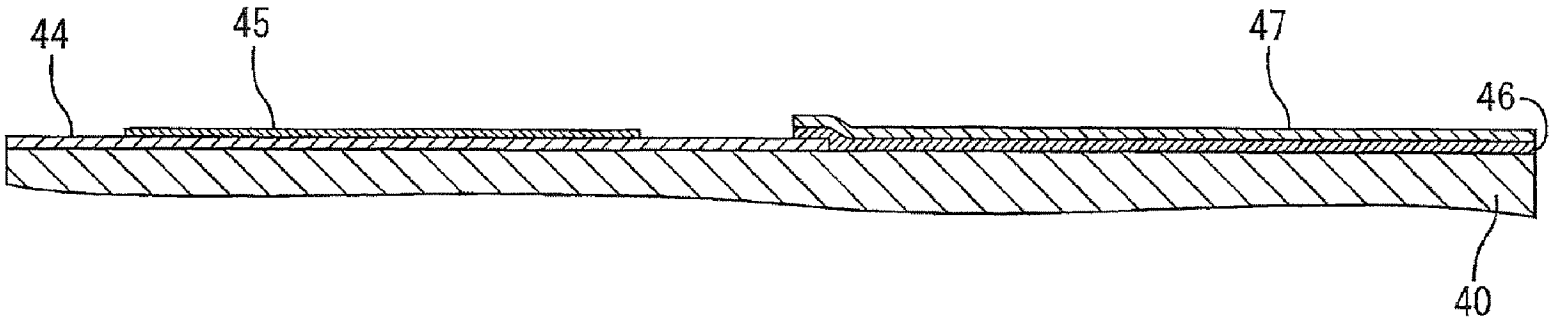
FIG. 9 is an enlarged section showing the construction of plating layers.

A base metal of this male terminal fitting 40 is a brass and a nickel plating layer 44 is formed on a surface thereof as in the first embodiment (see FIG. 9).

In FIG. 8, an area where the nickel plating layer 44 is formed is indicated by Ni and covers the entire area of the terminal contact portion 42 and an area up to a substantially middle position between the terminal contact portion 42 and the wire crimping portion 43. In other words, the nickel plating layer 44 is not formed in the wire crimping portion 43. Note that a gold plating layer 45 is formed on a part of the tab portion 41 near its leading end. This gold plating layer 45 is also formed by the so-called gold flash plating method and the thickness thereof is, for example, 0.4 μm to 0.8 μm.

On the other hand, a copper plating layer 46 having a thickness of, e.g. 0.5 μm to 1.0 μm is formed in an area of the wire crimping portion 43 where the nickel plating layer 44 is not formed (see FIG. 9). This copper plating layer 46 is preferably formed to partly overlap the nickel plating layer 44 at a boundary portion with the nickel plating layer 44 similar to the tin plating layer 23 in the first embodiment.

A tin plating layer 47 having a thickness of, e.g. 0.8 μm to 3 μm is formed on the copper plating layer 46. A method for forming this layer is as in the first embodiment and the formation area of the tin plating layer 47 is indicated by Sn in FIG. 8. As shown in FIG. 8, the tin plating layer 47 covers over the entire area of the wire crimping portion 43 and an area up to a position between extending base portions 48*a* of wire barrel pieces 48 at a side of the terminal contact portion 42 and the terminal contact portion 42.

This embodiment also has an excellent effect of being able to sufficiently suppress an increase of contact pressure between the wire 10 and the wire crimping portion 43 even upon being subjected to a thermal cycle similar to the first embodiment.

The present invention is not limited to the above described and illustrated embodiments. For example, the following embodiments are also included in the technical scope of the present invention.

Although the plating apparatus as shown in FIG. 6 is used upon partly forming the tin plating layers 23, 47 in the first and second embodiments, the present invention is not limited to terminal fittings formed using such an apparatus. Terminal fittings formed using any plating apparatus are embraced by the present invention provided that a nickel plating layer is present between a base metal and a gold plating layer in a terminal contact portion, but not present between the base metal and the tin plating layer in a wire crimping portion.

Figure 10:
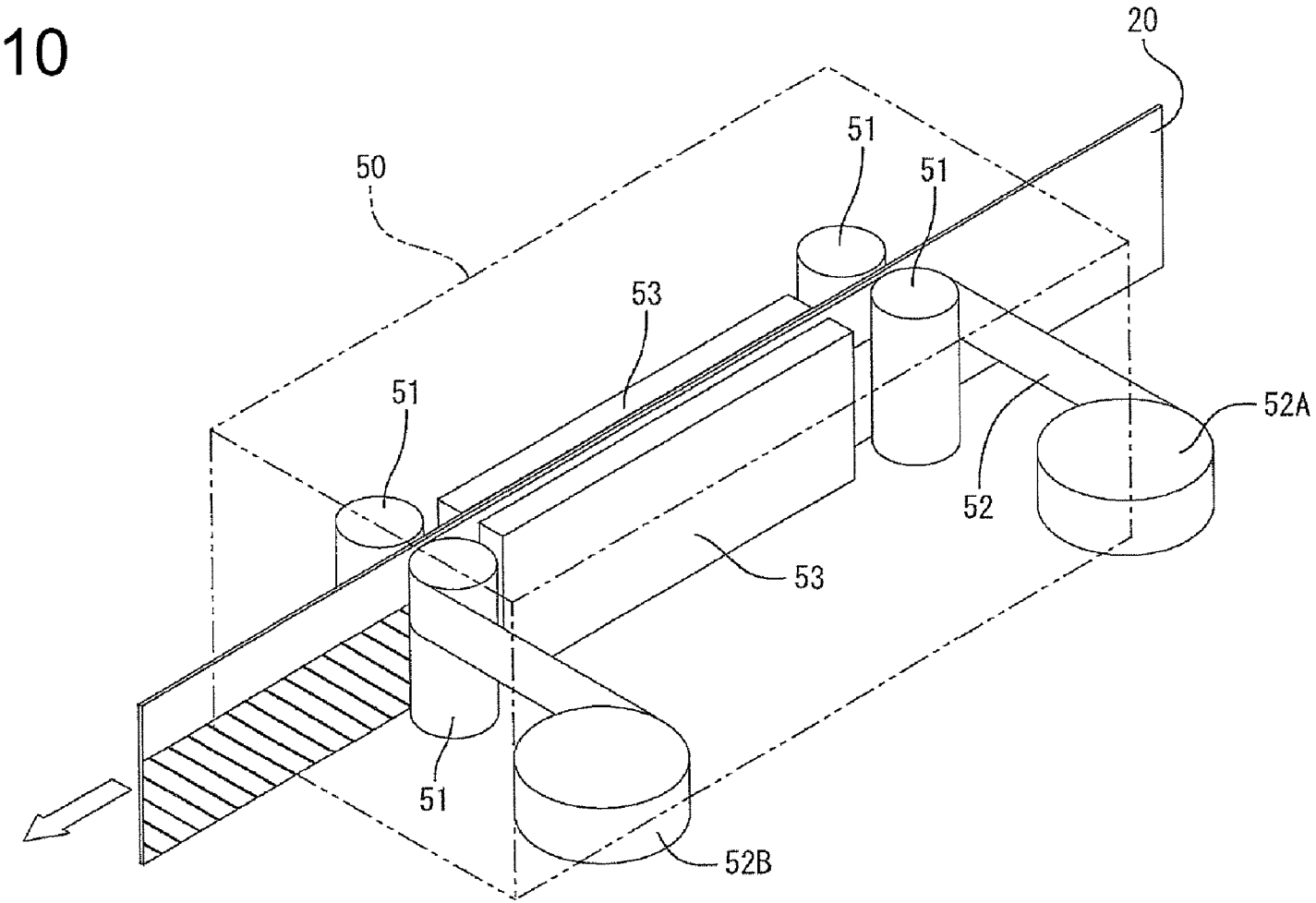
FIG. 10 is a perspective view showing another apparatus for partial plating.

For example, an apparatus of FIG. 10 may be used in place of the apparatus of FIG. 6. In FIG. 10, four guide rollers 51 stand in such a manner as to sandwich a base metal plate 20 in a plating bath 50, and a tape 52 made of, e.g. polyimide is adhered to a part of a surface of the base metal plate 20 traveling in the plating bath 50 to serve as a mask. The tape 52 is fed from a supply coil 52A located at an upstream side from which the base metal plate 20 is supplied and taken up by a take-up coil 52B located at a downstream side. Plating electrodes 53 are arranged at the opposite sides of the base metal plate 20.

Figure 11:
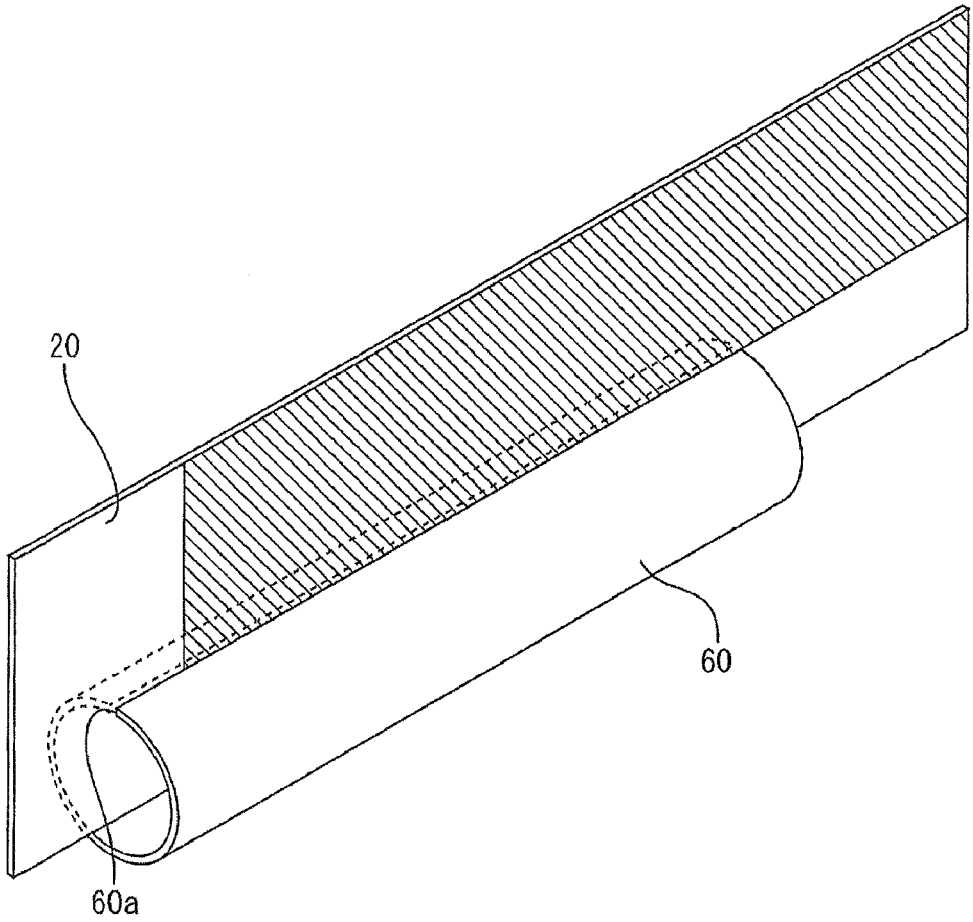
FIG. 11 is a perspective view showing still another apparatus for partial plating.
Figure 12:
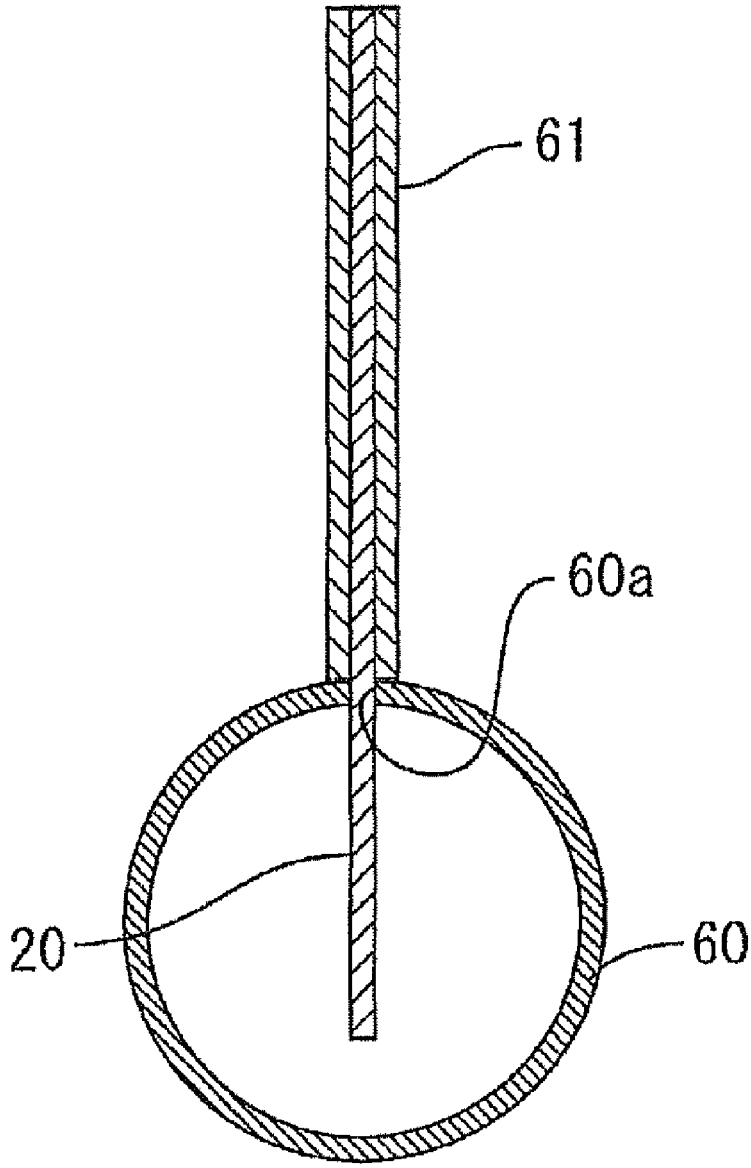
FIG. 12 is a section showing a state where a plating is formed by the apparatus of FIG. 11.

Alternatively, a plating method as shown in FIGS. 11 and 12 is also possible. According to this, the entire base metal plate 20 is so supplied into a plating bath (not shown) that a nickel plating solution does not adhere to the masked part by masking a part of the base metal plate 20 using a mask tube 60. The mask tube 60 is formed with a slit extending in a longitudinal direction, and a lower half of the base metal plate 20 can be concealed by inserting a lower edge portion thereof into this slit. Then, as shown in FIG. 12, a nickel plating layer 61 is formed only in a part not concealed by the mask tube 60.

Although the tin plating layer 23 is formed in contact with the surface of the base metal plate 20 made of a copper alloy in the first embodiment, the present invention is not limited to this and another metal plating layer or alloy plating layer may be formed between the tin plating layer 23 and the base metal plate 20. In short, it is sufficient that the nickel plating layer 21 as a base of the gold plating layer 22 is not present between the base metal and the tin plating layer in the wire crimping portion.

No nickel plating layer is formed in the entire area of the wire crimping portion in the above respective embodiments. However, in view of the fact that problems such as an increase of contact resistance are likely to occur at positions of the wire crimping portion where the core and the terminal fitting are held in contact by a strongest force, the nickel plating layer may not be formed between the base metal and the tin plating layer at least at the peripheral edges of edge portions formed by projections or recesses in the wire crimping portion in the case of forming the wire crimping portion with the recesses or projections (such as serration grooves). To this end, mask plating may be so applied as not to form the nickel plating layer in an area including the recesses or projections and their peripheral edge portions.

What is claimed is:

1. A terminal fitting comprising:

a terminal contact portion to be held in contact with a mating terminal;

a wire crimping portion to be crimped and connected to a core of an insulated wire;

a base metal extending along all of the terminal fitting;

a nickel plating layer applied to the base metal along the terminal contact portion;

a gold plating layer applied over the nickel plating layer at least at one location in the terminal contact portion; and a tin plating layer applied to the base metal along the wire crimping portion and overlapping a part of the nickel plating layer at parts of the terminal fitting spaced from the wire crimping portion so that no nickel plating layer is present between the base metal and the tin plating layer in the wire crimping portion.

2. A terminal fitting according to claim 1, wherein:

the terminal fitting is a female terminal fitting;

the base metal is a copper alloy; and the terminal contact portion includes a resilient contact piece to be held in contact with a mating male terminal.

3. A terminal fitting according to claim 1, wherein:

the terminal fitting is a male terminal fitting;

the base metal is a brass;

the terminal contact portion includes a tab portion to be held in contact with a mating female terminal; and a copper plating layer is present between the base metal and the tin plating layer in the wire crimping portion.

4. A terminal fitting according to claim 1, wherein:

the wire crimping portion includes a terminal bottom plate portion and a pair of wire barrel pieces extending from the terminal bottom plate portion; and the tin plating layer overlaps the part of the nickel plating layer at a position between extending base portions of the wire barrel pieces at a side of the terminal contact portion and the terminal contact portion.

5. A terminal fitting according to claim 2, wherein:

the wire crimping portion includes a terminal bottom plate portion and a pair of wire barrel pieces extending from the terminal bottom plate portion; and the tin plating layer overlaps the part of the nickel plating layer at a position between extending base portions of the wire barrel pieces at a side of the terminal contact portion and the terminal contact portion.

6. A terminal fitting according to claim 3, wherein:

the wire crimping portion includes a terminal bottom plate portion and a pair of wire barrel pieces extending from the terminal bottom plate portion; and the tin plating layer overlaps the part of the nickel plating layer at a position between extending base portions of the wire barrel pieces at a side of the terminal contact portion and the terminal contact portion.

7. A terminal fitting according to claim 1, wherein:

a recess or projection is formed on a surface of the base metal in the wire crimping portion; and the nickel plating layer is not present between the base metal and the tin plating layer in the wire crimping portion and the tin plating layer is in contact with the base metal at least at a peripheral edge of an edge portion formed by the recess or projection in the wire crimping portion.

8. A terminal fitting according to claim 1, wherein the gold plating layer is spaced from the tin plating layer.

* * * * *